US006176551B1

(12) United States Patent
Page

(10) Patent No.: US 6,176,551 B1
(45) Date of Patent: Jan. 23, 2001

(54) SURFACE PREPARATION APPARATUS AND METHOD OF USING THE SAME

(76) Inventor: James H. Page, 1405 Sinclair St., South Bottineau, ND (US) 58318

( * ) Notice: Under 35 U.S.C. 154(b), the term of this patent shall be extended for 0 days.

(21) Appl. No.: 08/941,173

(22) Filed: Sep. 30, 1997

(51) Int. Cl.[7] ..... E01C 23/088

(52) U.S. Cl. ..... 299/39.1; 299/39.4; 299/39.5; 299/39.6; 404/90; 172/684.5

(58) Field of Search ..... 404/90; 299/39.1, 299/39.4, 39.5, 39.6; 280/493; 172/677, 679, 684.5; 56/14.7, 15.1, 15.2, 15.5, 15.9

(56) References Cited

U.S. PATENT DOCUMENTS

| | | | | |
|---|---|---|---|---|
| 2,539,136 | * | 1/1951 | Hite | 404/90 |
| 2,787,943 | * | 4/1957 | Browning | 172/45 |
| 3,224,347 | * | 12/1965 | Seaman | 404/90 |
| 3,409,088 | * | 11/1968 | Lindbeck et al. | 427/499 |
| 3,606,469 | | 9/1971 | Hughes | 299/39.4 |
| 3,732,023 | * | 5/1973 | Rank et al. | 404/90 |
| 3,767,264 | | 10/1973 | Eckey | 299/39.5 |
| 3,868,146 | | 2/1975 | Ellis | 299/39.4 |
| 3,896,989 | | 7/1975 | Ellis | 404/90 |
| 4,175,886 | | 11/1979 | Moench et al. | 404/121 |
| 4,411,081 | | 10/1983 | King | 404/90 |
| 4,557,626 | | 12/1985 | McKay et al. | 404/90 |
| 4,704,045 | | 11/1987 | Taylor et al. | 404/90 |
| 4,780,022 | | 10/1988 | Ohiba et al. | 37/403 |
| 4,803,789 | | 2/1989 | Hackmack | 171/63 |
| 5,060,732 | | 10/1991 | Backett | 404/90 |
| 5,190,398 | | 3/1993 | Swisher, Jr. | 404/90 |
| 5,236,278 | | 8/1993 | Dickson | 404/90 |
| 5,297,894 | | 3/1994 | Yenick | 404/90 |
| 5,378,080 | | 1/1995 | Dickson | 404/90 |
| 5,388,893 | | 2/1995 | Maxwell et al. | 299/39.6 |
| 5,421,669 | | 6/1995 | Bertrand | 404/90 |
| 5,676,490 | * | 10/1997 | Nelson | 404/94 |

FOREIGN PATENT DOCUMENTS

| | | |
|---|---|---|
| 3420-989-A-1 | 12/1985 | (DE) . |
| 296847 | 7/1971 | (RU) . |

OTHER PUBLICATIONS

Model 78B Asphalt Recycler brochure, © Maddock Corporation, at least before Sep. 30, 1997.

Industry Advertisement placed by Guest Industries, Inc. in Public Works, Aug. 1997, p. 101.

Industry Advertisement placed by Guest Industries, in Heavy Equipment News, undated.

* cited by examiner

*Primary Examiner*—Eileen Dunn Lillis
*Assistant Examiner*—Sunil Singh
(74) *Attorney, Agent, or Firm*—Moore and Hansen

(57) ABSTRACT

A compact, easily transportable, surface preparation apparatus which includes a surface treatment unit having a cutter drum powered by its own power source. The apparatus includes transport/support wheels and a tow bar preferably interconnected at each end, of the surface treatment unit the rearward connection being a pivotal connection. The surface treatment unit has a longitudinal axis and a transverse axis, with the longitudinal axis perpendicular to the towing direction and the transverse axis coincident with the towing direction. The cutter drum has a rotational axis and is contained within the surface treatment unit and arranged such that the rotational axis is parallel to the longitudinal axis of the surface treatment unit. The cutter drum is off-set relative to the transverse axis of the surface treatment unit such that the cutter drum operates at one end of the surface treatment unit. The surface treatment unit is pivotally attached to the tow bar to enable the surface modifier to operate adjacent edges of a surface to be treated e.g., the shoulder of a road surface. The height and sideways tilt of the surface treatment unit may be adjusted as desired to produce surface profiles of different configurations.

26 Claims, 7 Drawing Sheets

SURFACE PREPARATION APPARATUS AND METHOD OF USING THE SAME

BACKGROUND OF THE INVENTION

The present invention relates to a surface preparation apparatus (SPA) for asphalt, concrete and other road surfaces, and in particular to a surface preparation apparatus which can be towed by various vehicles, which can be offset with respect to the direction of towing, and which can be adjusted in three axes. The preferred SPA is an asphalt reclaiming unit for being towed behind a truck of other prime mover.

Road surfaces, particularly asphalt road surfaces form a majority of road surfaces in the United States. Asphalt is also used in other applications, such as parking lots, biking paths and walking paths. A problem with asphalt is that is has a limited, useful life. When that useful life has been exceeded, the surface must be replaced or rehabilitated. Often, it is not desirable or cost effective to rehabilitate the entire road surface, particularly when only portions or segments of a paved section have deteriorated. As a result, the road surface is allowed to continue to deteriorate until use of a conventional full surface resurfacing unit becomes cost effective. The need to wait until the use of conventional resurfacing units becomes cost effective, results in temporary repairs such as patching, which are not as desirable as resurfacing. However, without a more cost effective manner resurfacing small areas, or portions of larger areas, resurfacing which might otherwise be completed if smaller, more flexible resurfacing units were available, will be delayed. Furthermore, there will be a tendency to redo surfaces which might not need to be done because only larger areas can be accommodated by the larger conventional units. Conventional units tend to be very large and heavy. They are often self propelled or attached to existing vehicle frames. The power for such units is generally supplied by one unit which means that some of the power is used to drive the vehicle and some of the power is used in the surface treatment apparatus. For this reason, those units are very slow. In addition, they can only be used to resurface large areas. It will be appreciated, therefore, that a need exists for a device for moving at greater speeds and preparing on a variety of surfaces such as shoulders, crowns, transitions, pipe lines, pot holes and the like.

Accordingly, it will be appreciated that there is a need for an efficient way of resurfacing asphalt, concrete and other surfaces used for roadways, walkways, parking lots and the like. The present invention provides advantages over the prior devices and the prior methods used to resurface these and other surfaces, and also offers other advantages over the prior art and solves other problems associated therewith.

SUMMARY OF THE INVENTION

The surface preparation apparatus of the present invention is compact, easily transportable, and includes a surface treatment unit which has a surface modifier or "cutter drum" powered by its own power source. The apparatus includes transport/support wheels and a tow bar pivotally interconnected with the surface treatment unit so that it may be towed by a truck or other vehicle having an independent power source. The surface treatment unit has a longitudinal axis and a transverse axis, with the longitudinal axis being perpendicular to the direction in which the units is towed (towing direction), and the transverse axis is coincident with the towing direction. The cutter drum has a rotational axis and is contained within the surface treatment unit and arranged such that the rotational axis is parallel to the longitudinal axis of the surface treatment unit. The surface modifier or cutter drum is preferably off-set relative to the transverse axis of the surface treatment unit such that the surface modifier operates substantially to one side of the surface treatment unit. The surface treatment unit is pivotally attached to the tow bar to enable the surface modifier to operate adjacent edges of a surface to be treated e.g., the shoulder of a road surface or the like. The height and sideways tilt of the surface treatment unit may be adjusted as desired to produce surface profiles of different configurations where the depth of the "cut" or the angle of the "cut" are varied.

One objective of the present invention is to provide a surface preparation apparatus which may be towed by various types of vehicles at a broader range of speeds than those which are possible with a conventional surface treatment unit.

Another objective is to create a compact surface preparation apparatus which is easily transported between locations.

Yet another objective is to concentrate weight and power on or to a surface modifier or "cutter drum".

A further objective of the present invention is to provide a surface preparation apparatus which rehabilitates surfaces at a high rate of speed.

Another objective of the present invention is to provide a surface preparation apparatus which is easily oriented in different directions with respect to a surface to be prepared.

Still another objective is remote control of a surface treatment apparatus by an individual.

A still further objective is to rehabilitate surfaces of various widths and compositions.

Another objective is to reduce the potential of injury due to flying debris.

These and various other advantages and features of novelty that characterize the present invention are pointed out with particularity in the claims annexed hereto informing a part hereof. However, for a better understanding of the present invention, its advantages and other objects obtained by its use, reference should be made to the drawings, which form a further part hereof and to the accompanying descriptive matter, in which there is illustrated and described preferred embodiments of the present invention.

BRIEF DESCRIPTION OF THE DRAWINGS

The invention will be further described in connection with the accompanying drawings, in which:

FIG. 3 is a right side elevation of the surface treatment unit shown in FIG. 1 in an elevated position;

DETAILED DESCRIPTION

Figure 1:
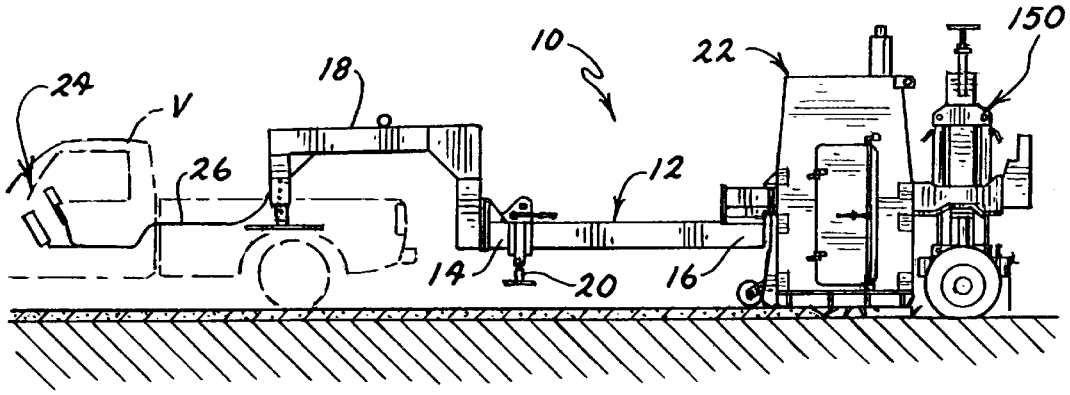
FIG. 1 is a side view of the preferred surface treatment apparatus of the present invention pivotally interconnected with a prime mover (shown in hidden lines)

Referring now to FIGS. 1–13, the surface preparation apparatus 10 of the present invention is generally shown in the FIG. 1. The surface preparation apparatus 10 includes a tow bar 12, a surface treatment unit 22 having a support mechanism 150. The tow bar 12 has first and second ends 14, 16. The first end 14 of the tow bar 12 is attached to a tow bar adaptor 18 or an extension 18 of the tow bar 12 which is pivotally connected to a tow vehicle or prime mover V. The second end 16 of the tow bar 12 fixedly secured to an extension 108. The tow bar 12 and the extension 108 are pivotally interconnected with the surface treatment unit 22 at a pivot point 120 behind a rotational axis 330 of a cutter drum 82 with respect to forward movement of the surface treatment unit 22 when pulled in a forward direction by the prime mover V. The first end 14 of the tow bar 12 is equipped with a jack 20 to assist in attachment and removal of tow bar 12 from a prime mover or tow vehicle V. In an alternate embodiment, the jack 20 may be supplanted with a wheeled support assembly 21', shown in FIGS. 12–13, to reduce the amount of weight supported by a tow vehicle or prime mover V'. In the alternate, embodiments of the apparatus 10' shown in FIGS. 12 and 13, the tow bar 12' includes two separate bars 12*a*', 12*b*' pivotally interconnected as shown.

The preferred surface preparation apparatus 10 is provided with a plurality of actuators which transmit power in a generally linear fashion. The preferred actuations are hydraulic cylinders, but other actuators, including but is not limited to pneumatic cylinders, linear motors, linear screws and the like may be used. In preferred embodiments such as that shown in FIGS. 1–11C, the actuators are hydraulic cylinders 132, 134, 202, 204, 214, 216.

In FIG. 1, the first end 14 of tow bar 12 is attached to a tow bar adaptor 18 which is in turn removably attached to a prime mover or tow vehicle V. Although the prime mover V as depicted in hidden lines in FIG. 1 is in the outline of a pickup truck, it is understood that other vehicles such as dump trucks, tractors, road graders, or the like may be utilized without departing from the spirit and scope of the invention. For example, if the surface treatment apparatus 10 is towed by another vehicle such as a dump truck or road grader, the tow bar adaptor 18 would be omitted and other mechanisms, known in the art for attaching towed units to towing vehicles, would be used. The surface preparation apparatus 10 also includes a remote control and monitor unit 24 which enable a person in the cab of a tow vehicle to control the surface preparation apparatus 10. The remote control and monitor unit 24 is electrically connected to the various actuators of the surface preparation apparatus 10 by electrical wiring within cable 26.

The surface treatment unit 22 of the preferred embodiment includes a housing 28 with an upper section 42 and a lower section 44. The preferred surface modifier is a cutter drum 82 contained within the lower section 44 of housing 28. The cutter drum 82 includes a plurality of cutter teeth 84 conventional to the art. Although the preferred surface modifier is a cutter drum as depicted in the FIGS. 3–11, it is understood that other surface modifiers known to the art may be utilized without departing from the spirit and scope of the invention. The cutter drum 82 is rotatably connected to a conventional power source or motor (not shown) which is contained within the upper section 42 of housing 28. In preferred embodiments the power source is a standard Caterpillar® 3056 engine which is a turbo changed, after cooled, inline 6 cylinder diesel 180 hp engine. The preferred clutch in an SAE#3, Rockford or equal, engine mounted. In other embodiments, having greater horse power, either 260 hp Caterpillar® 3126 engine can be used with a SAE#1 clutch, or a John Deere 6081A 275 hp engine with the SAE#1 clutch.

A support mechanism 150 is attached to, and extends rearwardly from the rear side 36 of housing 28. The support mechanism 150 includes a lift unit 188, a tilt mechanism 206, and support wheels 186.

Referring now especially to FIGS. 2–6 and 8A–11C the surface treatment unit 22 will be described in greater detail. Starting with a perspective view of the surface treatment unit 22, surface treatment unit 22 is generally rectangular with a length having a longitudinal axis L and a width having a transverse axis TV. The surface treatment unit 22 is oriented such that the longitudinal axis L of the surface treatment unit 22 is generally perpendicular to towing direction T (not shown). The surface treatment unit 22 comprises a housing 28 having an upper section 42 and a lower section 44, with a power source located within the upper section and a surface modifier located within the lower section. The surface modifier has a rotational axis 230 which is parallel with the longitudinal axis L of the surface treatment unit 22. The cutter drum 82 extends only partially along the width of the surface treatment unit 22 which extends along the longitudinal axis L, and preferably is offset or located to one side with respect to the transverse axis TV of the surface treatment unit 22. This arrangement enables the cutter drum 82 to treat those surfaces to one side of the line of force defined by the towing direction T. Preferably the cutter drum 82 is located to the right of the transverse axis TV the surface treatment unit 22, but it will be understood that the cutter drum 82 may be located to the left of the transverse axis TV of the surface treatment unit 22, or even be centrally located with respect to the transverse axis TV without departing from the spirit and scope of the invention.

Figure 11C:
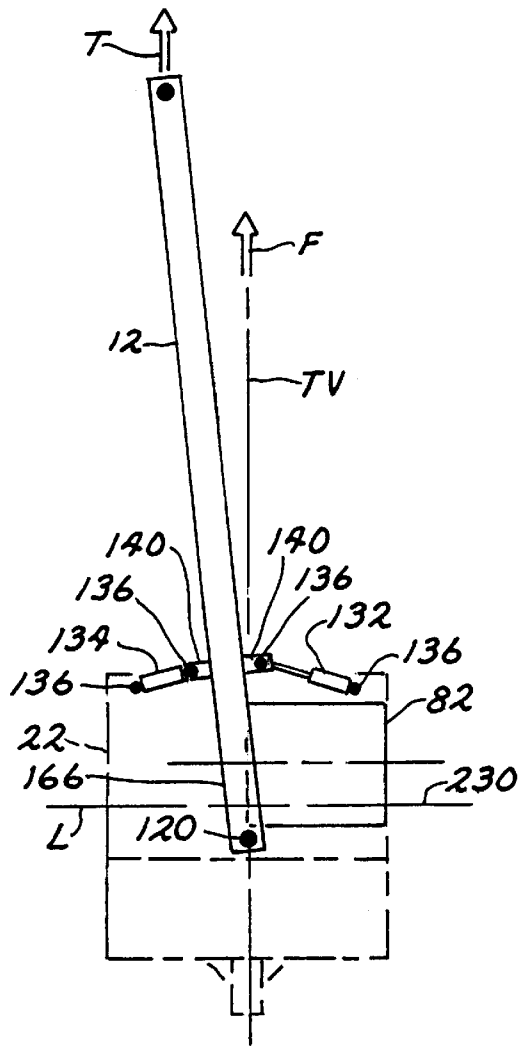
FIGS. 11A–11C are schematic top views depicting the tow bar attached to the surface treatment unit of FIG. 1 in normal, left and right orientations, respectively.

In the preferred embodiments, the surface treatment unit (STU) 22 will follow the prime mover V in a following direction F which is parallel with the transverse axis TV of the surface treatment unit 22 and perpendicular to the longitudinal axis L and the rotational axis 230 of the cutter drum 82. When the prime mover V drawing the surface treatment unit 22 is traveling in a straight line, and the surface treatment 22 is offset to the left or right as shown in FIGS. 11B and 11C, the towing direction T and the following direction F will always be parallel with one another, because the hydraulic cylinders 132, 134 drive the STU 22 to one side or the other, but maintain this orientation so that the cutter drum 82 will cut in a straight and consistent path.

The front side 30 of lower section 44 of housing 28 includes a front debris shield 50 which serves to contain fragments of surface material dislodged by cutter drum 82 within housing 28. Front debris shield 50 is slideably mounted to housing 28 by pins 60 which pass through two parallel slots 52 which are sized to admit the pins 60. The front debris shield 50 is retained on the pins 60 by washers 62 and retainers 64 which are removably attached to the pins 60, preferably threadably attached. The front debris shield 50 includes a bracket 54 which supports a surface follower 56. The surface follower 56 is a wheel which is rotatably mounted on a bracket 54. In operation, surface follower 56 tracks surface S and moves front debris shield 50 upwardly or downwardly depending on the level of the surface S. Front debris shield 50 also includes a skid plate 58 which enables the front debris shield to ride along an uneven surface S. Front debris shield 50 includes a chain 66*a* attached thereto, having a plurality of links 67 which are sized to be removably received in one of a plurality of keyhole slots 48*a* in the upper section 42 of housing 28. Chain 66*a* enables the front debris shield 50 to be positioned at different elevations to facilitate servicing.

Figure 4:
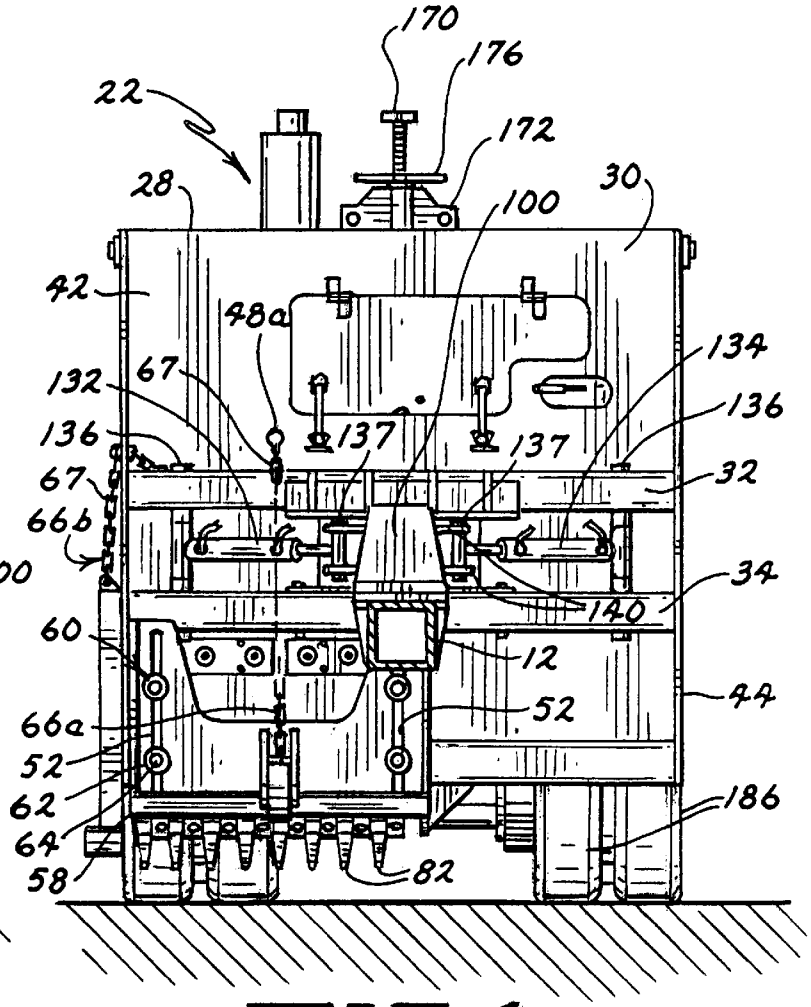
FIG. 4 is a front elevation of the surface treatment unit shown in FIG. 3.

The lower section 44 also includes an outside debris shield 70. The outside debris shield 70 is slideably mounted to housing 28 in the same manner as the front debris shield 50, by means of slots 72, pins 74, washers 76 and retainers 78. Outside debris shield 70 also includes skid plate 80 and two chains 66*a*, 66*c* which also are removably received in keyhole slots 48*b*, 48*c* on the upper section 42 of housing 28. An inside debris shield 71, which includes a sidewall, is depicted in FIG. 4.

Figure 2:
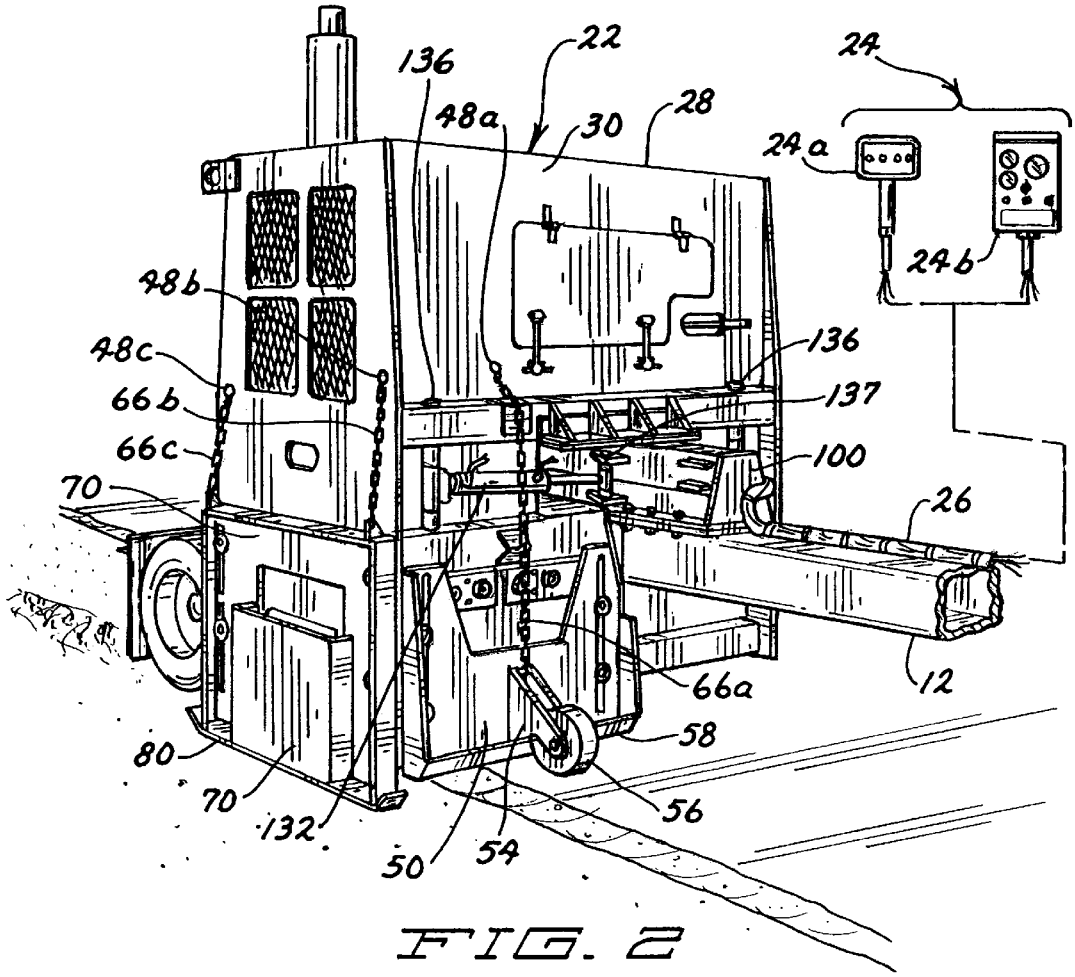
FIG. 2 is a perspective view the surface treatment unit shown in FIG. 1.

As shown in FIGS. 1 and 2, the surface preparation apparatus includes a remote control and monitor system 24, including cable 26 which enables one person to operate the apparatus from a prime mover or tow vehicle V. The system 24 includes a simple toggle switch control unit 24*a* which allows the user to actuate each of the three pairs of hydraulic cylinder 132 and 134, 202 and 204, and 214 and 216 which allow the STU 22 to (1) pivot with respect to the tow bar 12 so as to be offset to the left or right with respect to the transverse axis TV; (2) raise or lower with respect to the surface S; or (3) tilt to the left or the right with respect to the longitudinal axis 240 of the wheels 186. The monitoring unit 24*b* provides indications of the relative position of the STU 22 in regard to the extremes of these variations.

In a preferred embodiment, the hydraulic system is an open center, return line filter, solenoid operated system having in-cab pendent controls for raising and lowering the STU 22; swing the STU 22 to the left or right; or tilting the STU 22 to the left or right. Preferred indicators include an oil pressure gauge, and engine temperature gauge, and a tachometer; other controls include a master switch, a key start/stop, an electric throttle control, and an emergency stop palm switch.

As shown in FIG. 3, the surface treatment unit 22 is pivotally attached to and supported by tow bar 12 and support mechanism 150. The second end 16 of tow bar 12 is bolted or otherwise affixed to a first end 102 of a first beam frame 100. The first beam frame 100 includes a first support surface 106 which slideably engages a flange 46 which is affixed to an upper beam 32 attached to the front side 30 of housing 28. Shown in hidden lines, the first frame 100 extends partially into housing 28. Also in hidden lines is an extension 108 with a first end 110 and a second end 112, with the first end 110 is welded or otherwise affixed to the second end 104 of the first frame 100. The extension 108 extends rearwardly from the first frame 100 and terminates at a second end 112 adjacent the rear side 36 of housing 28. The second end 112 is pivotally engaged with a vertical pivot pin 120 which is fixedly retained within a generally vertical aperture (not shown) in extension 108 and which extends upwardly and downwardly from the second end 112 of the extension 108. The vertical pivot 120 engages an upper beam 38 and a lower beam 40 which are attached to and extend horizontally along the rear side 36 of housing 28.

Attached to, and extending rearwardly from housing 28, is the support mechanism 150. The support mechanism 150 includes a second frame 152 attached to housing 28, and a lift unit 188 which is adjustably connected to the second frame 152 and pivotally connected to a third frame 180. The lift unit or mechanism 188 includes column 192 which is pivotally secured to the second frame 180, and third and fourth actuators 202, 204, in electrical communication with the control unit 24*a*, which are adjustably attached between brackets 164 and 200 to enable first and second columns 158, 192 to telescope relative to each other, thus raising or lowering surface treatment unit 22 as the third and fourth actuators 202, 204 are extended or retracted. Although two actuators are depicted in the illustrations of the preferred embodiment, the particular number of actuators used can vary without departing from the spirit and scope of the invention. Brackets 200 are secured, preferably welded, to a U-shaped pivot frame 201 which includes sleeve 190 which rotatably encircles horizontal pivot pin 182 which pivotally joins the U-shaped pivot frame 201 to the third frame 180. The third frame 180 is secured to axle 184, to which wheels 186 are rotatably attached. The first end 154 of the second frame 152 is attached to housing 28 at the rear side 36. A bumper or push bar 178 is attached to a second end 156 of the second frame 152. The first column 158 has upper and lower ends 160, 162. The first column is attached to the second frame 152 proximate the lower end 162 such that the upper end 160 lies above the horizontal plane of the second frame 152. The first column 158 slidingly receives the second column 192 of lift unit 188. About midway along the length of the first column 158 and attached thereto, are brackets 164,200 onto which the hydraulic cylinders 202, 204 of the lift mechanism 188 are adjustably connected.

The third frame 180 includes additional elements of the lift unit 188. The third frame 180 includes an axle 184 having a longitudinal axis 240 which rotatably supports wheels 186 in a conventional manner. The third frame 180 also includes a horizontal pivot 182 (FIG. 6) having a longitudinal axis (not shown) which is perpendicular to the longitudinal axis 240 of the axle 184. The horizontal pivot 182 rotatably carries a sleeve or collar 190 (FIG. 6) within the U-shaped pivot frame 201, to which a lower end 194 of the second column 192 is attached. Second column 192 is sized to be slideably received by first column 158 in a nesting or telescoping arrangement. A pair of brackets 200, attached to a pair of U-shaped brackets 210, 212 which are integrally joined to the sleeve or collar 190 to form the U-shaped pivot frame 201, (see FIG. 6) onto which components of the lift unit are connected.

The front side of the surface treatment unit 22, depicted in FIG. 4, shows the arrangement of an offset or shift mechanism consisting primarily of hydraulic cylinders 132, 134 which cause the STU 22 to pivot with respect to tow bar 12. The cylinders 132, 134 are connected between housing 28 and first frame 100 which is fixed to the tow bar 12. The front side 30 of housing 28 includes and upper beam 32 and a lower beam 34. The upper and lower beams include apertures which engage support mounting pins 136. The first frame 100 includes a pair of brackets 140 located on either side thereof which include apertures which engage mounting pins 137. First and second hydraulic cylinders 132, 134 are attached to the mounting pins 136, 137 so that they are positioned adjacent the housing 28 and the first frame. The cylinders 132, 134 enable the surface treatment unit 22 and the support mechanism 150 to rotate about the vertical pivot 120 with respect to first frame 100 and tow bar 12. Although two cylinders are depicted, the particular number of cylinders, or other linear actuators used in alternate embodiments can vary without departing from the spirit and scope of the present invention.

Although the preferred embodiments of the present invention have a cutter drum 82 off-set to the left or right of the transverse axis TV of the housing 28, and the tow bar 12 is preferably interconnected with the housing 28 at a pivot point well behind the rotational axis 230 of the cutter drum 82 with respect to movement of the STU 22 in a forward direction when being drawn by the prime mover V, alternate embodiments of the present invention include STUs (not shown) wherein the cutter drum is not off-set to either side of such a transverse axis, and/or the main pivot point interconnecting the tow bar to the housing is either forward of, or immediately above the rotational axis 230 of the cutter drum.

Figure 5:
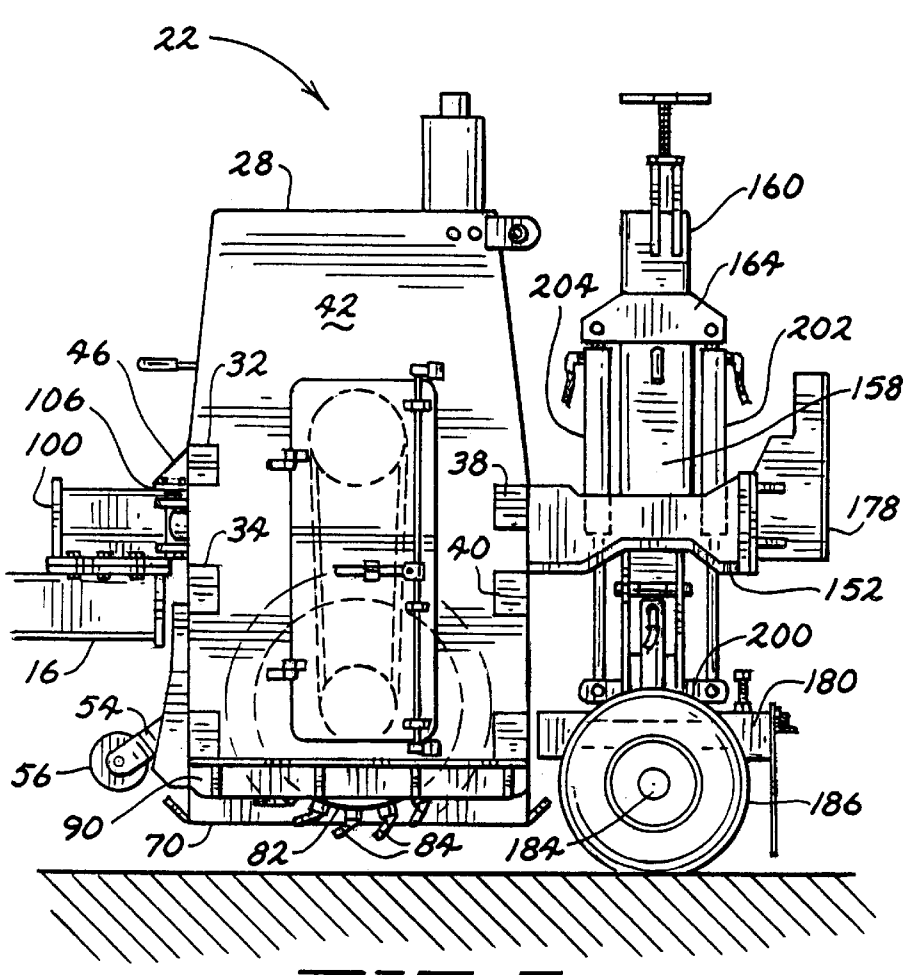
FIG. 5 is a left side elevation of the surface treatment unit shown in FIG. 3 in a raised position.

Another view of the surface treatment unit 22 is shown in FIG. 5. FIG. 5 is a left side elevation in which the cutter teeth 84 of the cutter drum 82 can be seen. The cutter teeth 84 are standard teeth available in the industry. Preferred teeth are standard weld-on blocks with knock-in/knock-out bits or optional quick change bolts in holder blocks. Although specialty drums as are known in the art within the scope of the present invention a preferred drum is arranged with teeth in a standard "staggered CHEVRON" pattern for maximum breakout force and horse power requirements.

Figure 6:
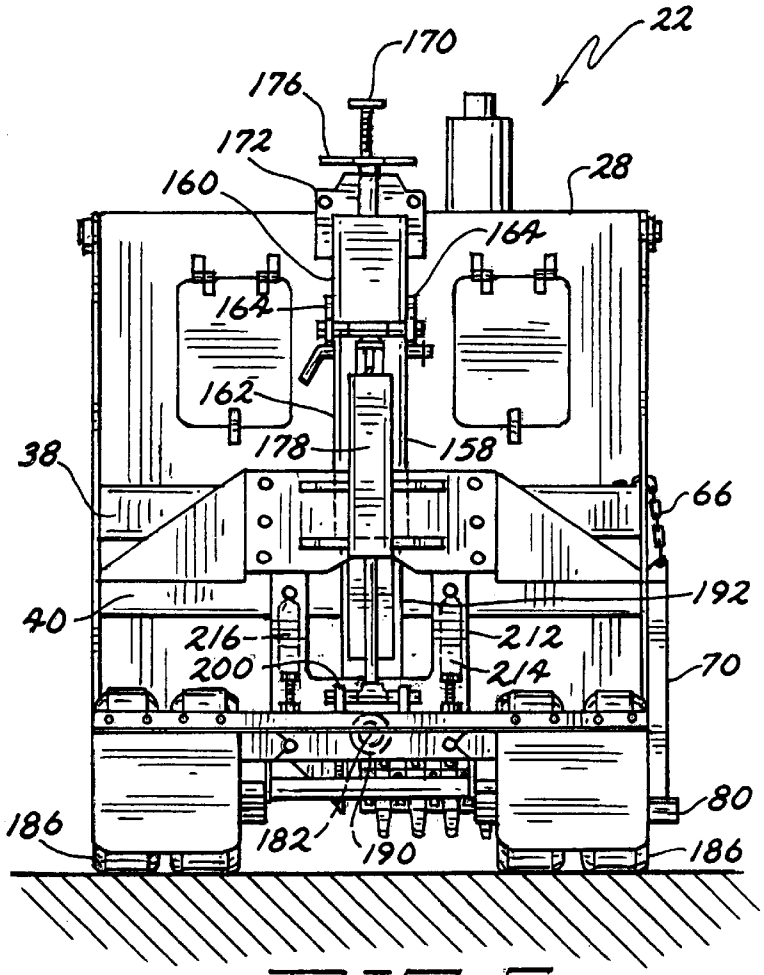
FIG. 6 is a rear elevation of the surface treatment unit shown in FIG. 5.

The support 150 and the rear side 36 of surface treatment unit 22 illustrated in FIG. 6. The tilt mechanism is actuated by a pair of cylinders 214, 216, secured between a pair of U-shaped brackets 210, 212 which are attached to the collar 190 of the lift unit 188. The cylinders 214, 216 which are adjustably connected between the brackets 210, 212 and the third frame 180. The first U-shaped bracket 210 and a second U-shaped bracket 212 are attached to the collar or sleeve 190 so that they are transverse to the horizontal pivot 182 and the arms extend upwardly from a plane (not shown) passing through the pivot 182 proximate the third frame 180. The brackets 210, 212 are secured to the second column 192 which moves up and down freely within the first column 158 which is secured to the second frame 152. The upper ends of the first and second brackets are adapted to be connected to upper ends of the fifth and sixth cylinders 214, 216. When the cylinder 214, 216 are alternately extended or contracted, the third frame 180 rotates about the horizontal pivot 182 relative to the surface treatment unit 22, the U-shaped pivot frame 201 and the lift unit 188. As the lift unit 188 raises and lowers the surface treatment unit 22, the U-shaped brackets will move up and down freely with respect to the second frame 152. Although two cylinders are depicted, the particular number and type of linear actuators used can vary without departing from the spirit and scope of the invention. Moreover, although U-shaped brackets are depicted, other bracket configurations are also possible.

Figure 7A:
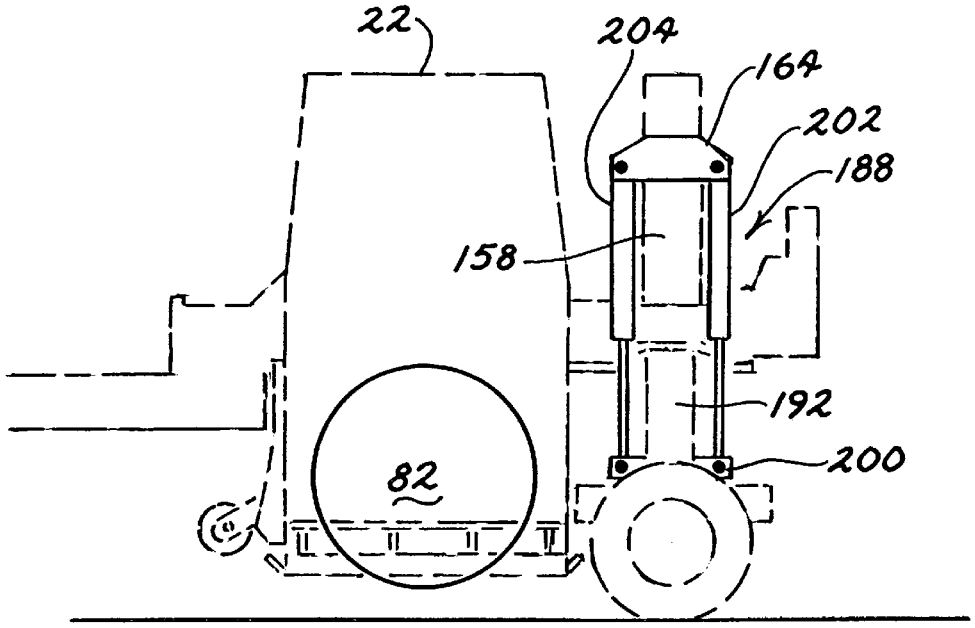
FIG. 7A is a schematic view of the left side of a lift unit of the surface treatment unit of FIG. 1 in an raised position.
Figure 7B:
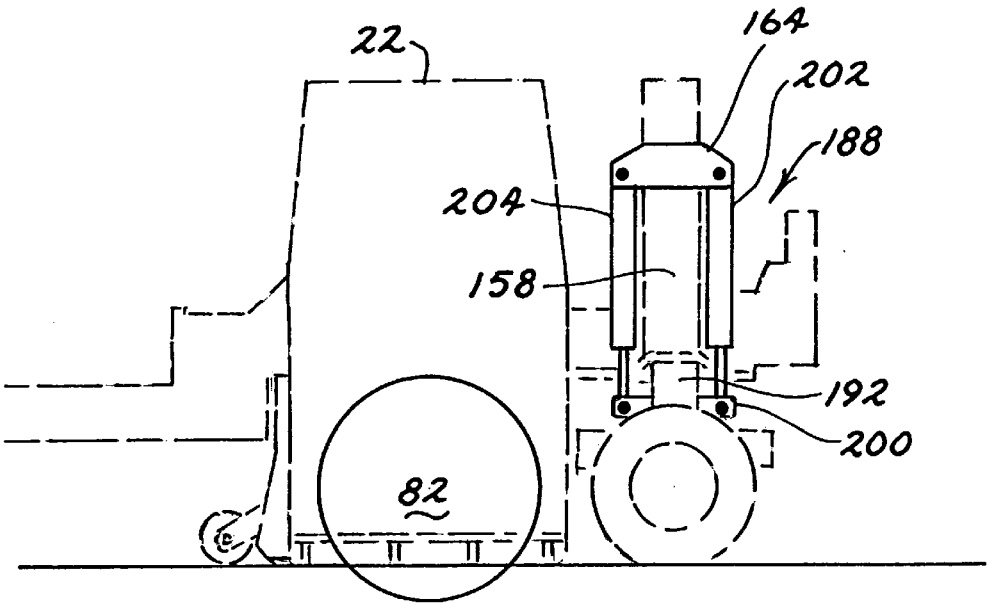
FIG. 7B is a schematic view of the left side of the lift unit of FIG. 1 of the surface treatment unit in a lowered position.

FIGS. 7A and 7B depict the lift unit 188 as the third and fourth cylinders 202, 204 are extended in 7A and withdrawn in 7B. In 7A, the surface treatment unit 22 is raised and supported by support wheels 186 and a prime mover or tow vehicle (not shown). In 7B, the surface treatment unit 22 lowered so as to be is adjacent to or resting upon a surface to be modified.

Figure 8A:
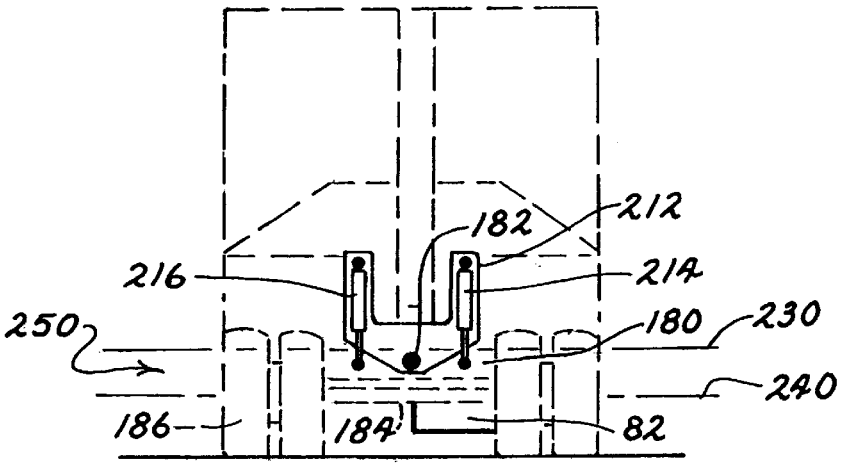
FIGS. 8A–8C are schematic end views of the tilt mechanism of the surface treatment unit of FIG. 1 in vertical, left and right orientations, respectfully.
Figure 8B:
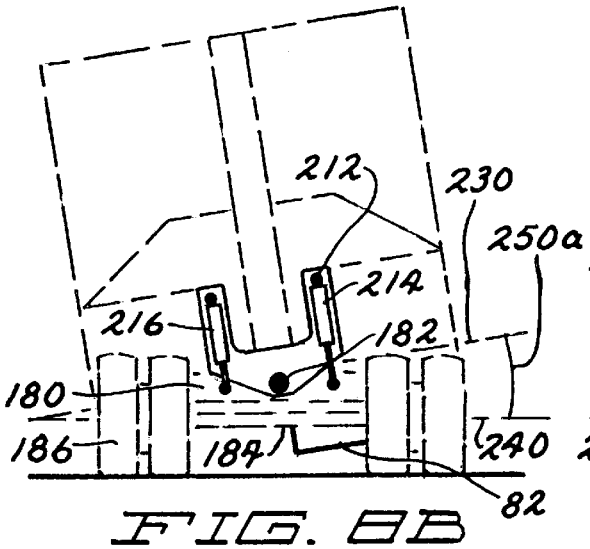
Figure 8C:
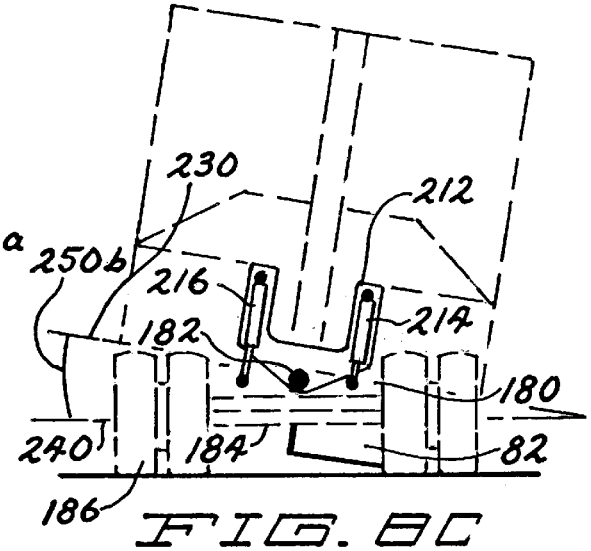
Figure 9:
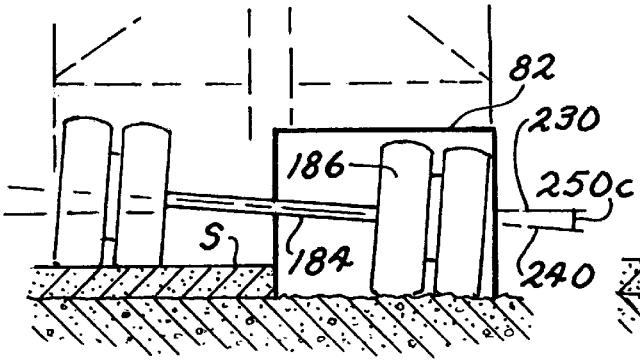

FIGS. 8A, 8B, and 8C depict the tilt mechanism of the surface treatment unit 22 in various stages of tilt with respect to support wheels 186. In FIG. 8A the tilt mechanism is in a neutral orientation, where the rotational axis 230 of the cutter drum 82 is parallel to the longitudinal axis of the axle 240. In FIG. 8B, the surface treatment unit 22 is tilted to the left with respect to the third frame 180, where the rotational axis 230 of the cutter drum 82 is at an angle 250 relative to the longitudinal axis of axle 240. In FIG. 8C, the surface treatment unit 22 is tilted to the right with respect to the third frame 180, where the rotational axis 230 of the cutter drum 82 is at an angle 250*b* relative to the longitudinal axis 240 of axle 184.

Figure 9:
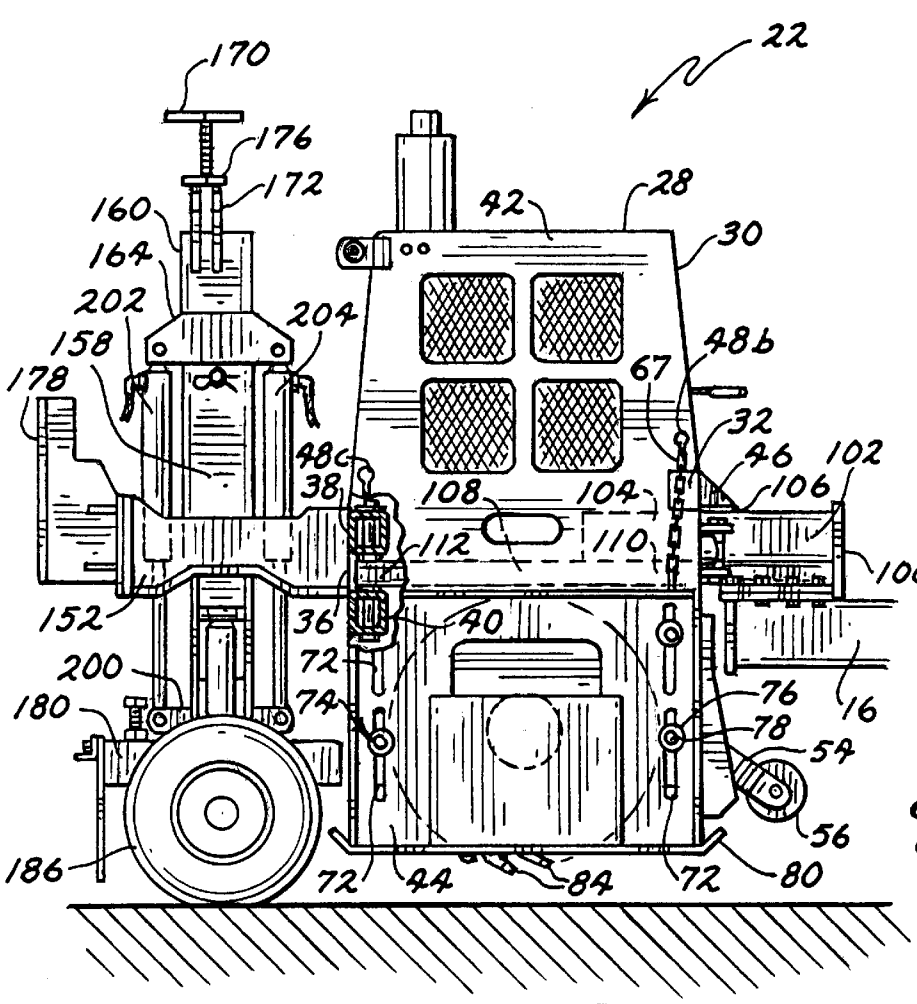
FIG. 9 is a partial rear schematic views of the surface modifier or "cutter drum" and the support wheels of the surface treatment unit of FIG. 1.

FIG. 9 shows the cutter drum 82 in relation to the support wheels 186 as the cutter drum 82 removes a uniform layer from a surfaces to be treated. Note that the tilt mechanism enables the cutter drum 82 to compensate and make the uniform cut in spite of the uneven surfaces upon which the wheels 186 pass over.

Figure 10:
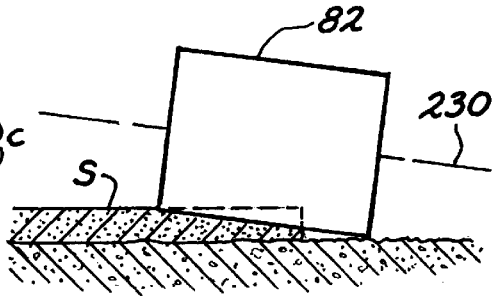
FIG. 10 is a schematic view of a "cutter drum" or surface modifier of the present invention in relation to a surface to be prepared.

FIG. 10 shows the position of the cutter drum 82 as used to remove a shoulder of a surface S to create a smooth transition between two levels. Here, the rotational axis 230 of the cutter drum 82 and the longitudinal axis of the axle (not shown) may very well be parallel to each other. This demonstrates the flexibility of the present STU 22, providing users with greater capabilities when preparing pavement and the like for subsequent resurfacing operations.

Figure 11A:
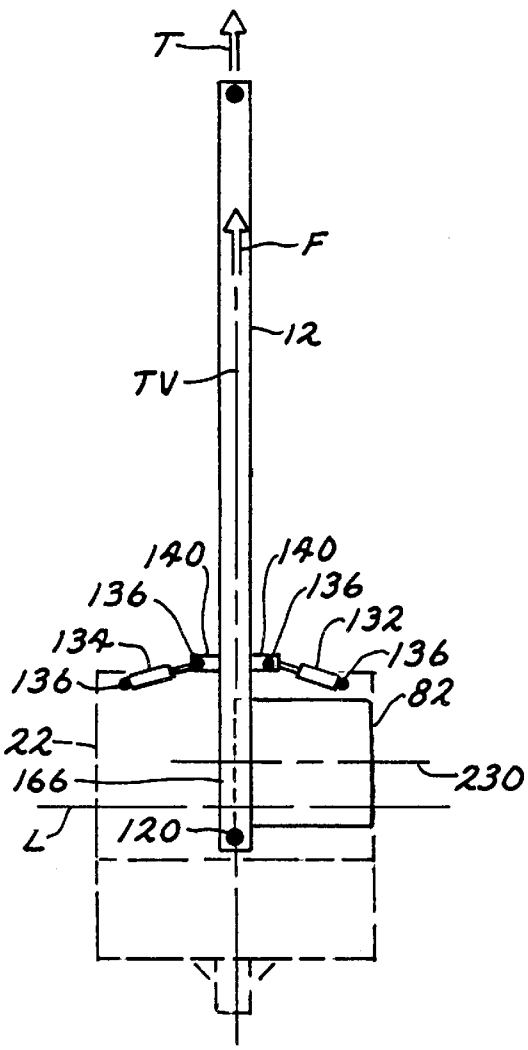
Figure 11B:
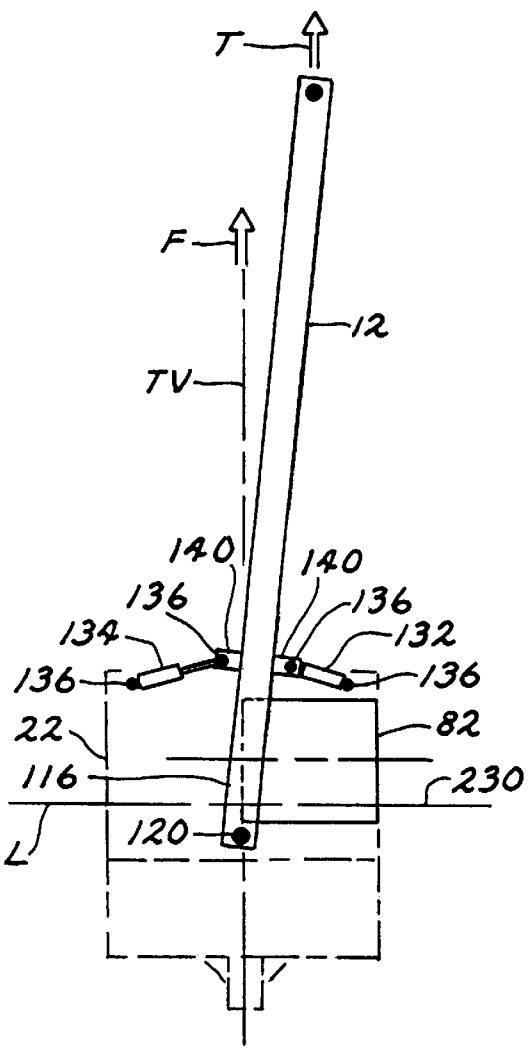

FIGS. 11A, 11B, and 11C depict the offset mechanism as it manipulates the surface treatment unit 22 to the center when following directly behind the tow vehicle, to the left side of the direction of travel T when the STU 22 is offset to the left and to the right side when the STU 22 is offset to the right. Shown in schematic form, the tow bar, first frame, and extension are depicted as a single integral unit which extends from the point of attachment to a prime mover or tow vehicle (not shown) to the vertical pivot 120 to which the surface treatment unit 22 (shown in dashed lines) is rotatably attached. It will be appreciated from these plan views, that the pivotal attachment of the tow bar 12 or the extension thereof is well behind the rotational axis 230 of the cutter drum 82 with respect to the direction of travel T. As can be seen, cutter drum 82 is offset toward the right end of the surface treatment unit 22.

When first and second cylinders 132, 134 are extended and withdrawn, the surface treatment unit 22 is rotated about the vertical pivot 120. Although two cylinders are depicted, the particular number and type of linear actuators used can vary without departing from the spirit and scope of the invention.

As mentioned above the standard engine used in the present STU 22 is a 180 horsepower Caterpillar® engine. Preferred embodiments of the STU 22 of the present invention have a 260 horsepower Caterpillar® diesel engine. The preferred cutter drum 82 is 40 inches wide along its rotational axis 230. In the standard STU 22, the ration of horsepower to feet of cutter drum surface is 54. In the preferred embodiment having a 260 hp engine that ratio is 78, and if the engine has as much as 275 horsepower, that ratio will be 82.5.

The ratio of horsepower to feet of cutter drum surface (HP ratio) is important because a higher HP ratio enables the STU 22 to cut through asphalt and other surfaces at a faster rate of speed. That means that the STU 22 can be pulled at a faster rate and the surface can be prepared, or "reclaimed" at a faster rate. In preferred embodiments of the present invention the STU 22 will have an HP ratio of at least about 45 (e.g. 40" cutter drum and 150 hp engine); preferably at least about 48 (e.g. 40" cutter drum and 160 hp engine); more preferably at least about 51 (e.g. 40" cutter drum and 170 hp engine); even more preferably at least about 54; (e.g. 180 hp engine); even more preferably at least about 57; (e.g. 190 hp engine) even more preferably at least 60 (e.g. 200 hp engine); even more preferably at least about 63 (e.g. 210 hp (engine); even more preferably at least about 63 (e.g. 210 hp engine); even more preferably at least about 66 (e.g. 220 hp engine); even more preferably at least about 69 (e.g. 230 hp engine); even more preferably at least about 72 (e.g. 240 hp engine); even more preferably at least about 75 (e.g. 250 hp engine); even more preferably at least about 78 (e.g. 260 hp engine); even more preferably at least 82.5 (e.g. 275 hp engine).

It will be appreciated that the prior art devices are not directed toward speed of cutting, but rather to large areas. When using a device for smaller areas, speed may be an even bigger factor because the faster the one job can be completed, the faster the workers can get on to the next job and the less need there will be for conventional resurfacing units. The present apparatus will effective cut a path through an asphalt road surface when drawn at speeds of greater than about 0.5 miles per hour (mph), preferably about 0.75 mph, and more preferably about 1.0 mph.

The weight of the STU 22 is also a factor because the weight of the unit, the more consistent the cutting function will proceed. The preferred STU 22 will weigh approximately 8.5 tons, preferably 8.58 tons, and the ratio of weight to feet of cutter drum surface (weight ratio will be at least about 5000, preferably at least about 5100, more preferably at least about 5150.

Alternate embodiments of the present STU will include a reservoir to store rejuvenating fluids which can be mixed with asphalt as the asphalt is reclaimed or pulverized. Such fluids are well known in the art and include polymer asphalt emulsions such as those sold by Koch Petroleum. These fluids prepared the pulverized asphalt for rolling which will complete the resurfacing process.

The most preferred STU 22 has a 260 horsepower Caterpillar® diesel engine. The unit also is equipped with quick change holder blocks for the bits. When towed with a pick up truck, the depth of cut is somewhat more limited, as compared to towing with a tractor, road grader, dump truck or the like. The maximum cut depth is generally about 12" deep.

The overall cost of operation of any reclaiming machine should include the cost of transporting, travel permits, maneuverability, operator skill level and other considerations. When these costs are considered, the use of the present invention is exceptionally cost efficient, not only from an original price basis but simply on a day to day operating basis as well.

Typical road vehicles employed in the United States, and perhaps elsewhere, have a width of generally about 8'4" to about 8'6". Machinery and other trailer type devices which are towed behind such vehicles generally conform to the same widths so that these trailer-type devices can easily seen by the operators of the vehicles using their outside mirrors during any towing activities. However, these vehicles and the trailer-type devices they generally tow are not easily shipped overseas in multiple mode shipping containers of the type now in common use in commercial trade both regionally and internationally. One key problem is the these vehicles, and the trailer-type devices the often pull, are generally to wide to fit into these containers because the containers have an inside width of only 7'4". Therefore, large equipment which must be shipped cannot be shipped in these multiple mode containers if they are too wide to fit in the containers.

In preferred embodiments of the present invention, the housing 28 of the STU 22 is less than about 7'4" wide, in order to fit easily into a standard shipping container used for "container shipping" which has a standard inside width of 7'4". Preferably, the width of the housing will be about 7'3" or less, preferably about 7'2" or less. In alternate embodiments (not shown) the tow bar may be shipped in a number of pieces, unassembled, so that the entire SPA can be enclosed in a single multiple mode shipping container of the type known in the art for shipping overseas on container carrying ocean going vessels.

Figure 12:
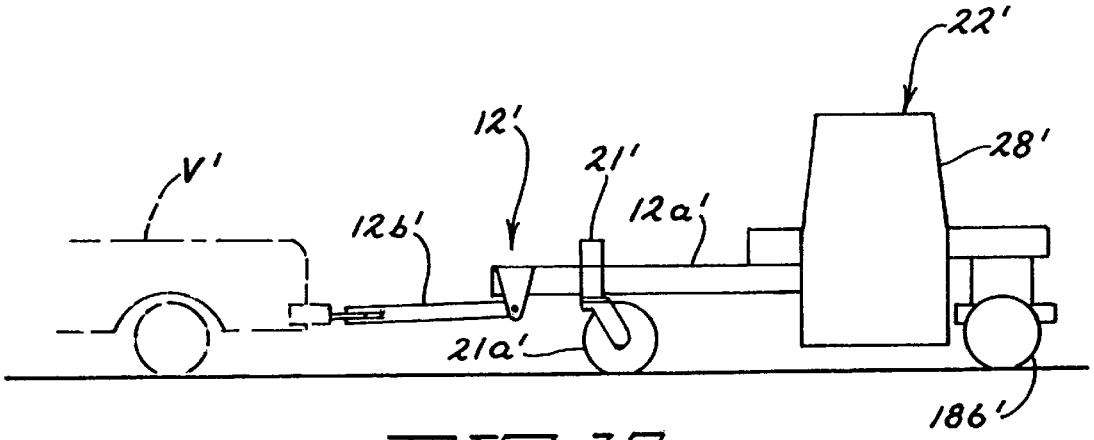
FIG. 12 is a schematic side elevation of an alternate surface treatment apparatus having a horizontally pivotal tow bar and a front axle wheel assembly to reduce the weight on the prime mover.
Figure 13:
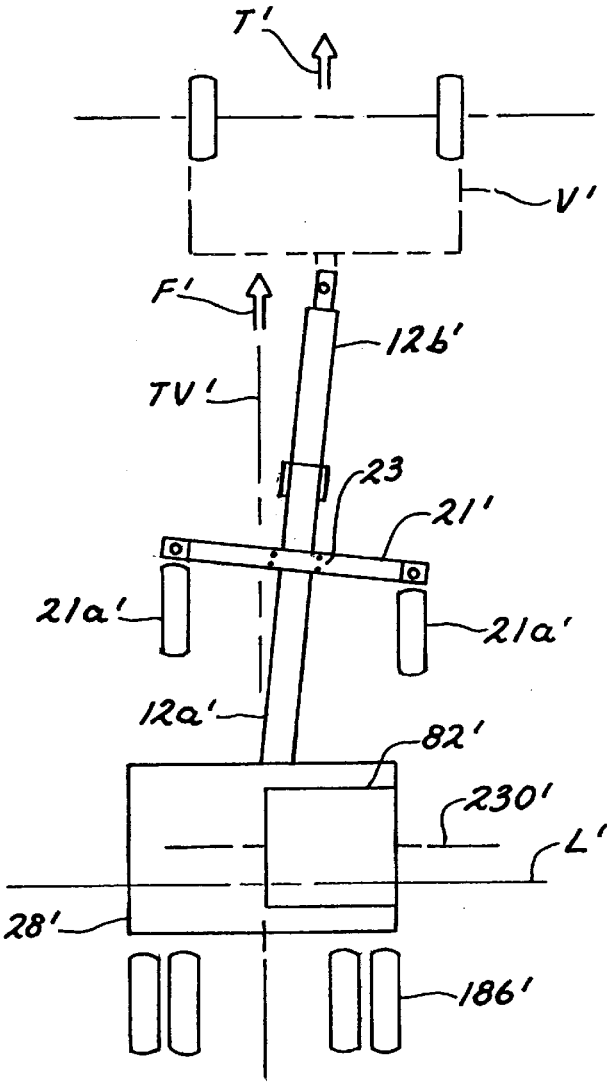
FIG. 13 is a top schematic view of the alternate embodiment shown in FIG. 12.

In FIGS. 12 and 13, an alternate surface preparation apparatus 10' is illustrated which includes a tow bar 12' having two horizontally pivotally connected end portions 12*a*' and 12*b*' and a wheeled support assembly 21' having a pair of heavy duty caster wheels 21*a*'. The support assembly 21' is secured to the first end portion 21*b*' of the tow bar 12' with a pair of u-bolts 23'. The support assembly 21' may be provided when the weight of the STU 22' is too great for the prime mover V' to support. The horizontal pivot 25' of the tow bar 12' allows the weight of the STU 22' to rest entirely upon the wheels 21*a*' of the assembly 21'. It will be appreciated that the u-bolts 23' may loosened, and the support assembly may be slideably moved along the length of the first portion 12*a*' of the tow bar 12' to reduce the length of separation between the wheels 21*a*' of the support assembly 21' and the wheels 186' of the STU 22', thereby lowering the leverage placed upon the caster wheels 21*a*' by the weight of the STU 22'.

It is to be understood, however, that even though numerous characteristics and advantages of the present invention have been set forth in the foregoing description, together with details of the structure and function of present invention, the sequence or order of the specific steps, or the actual compositions or materials used may vary somewhat. Further more, it will be appreciated that this disclosure is illustrative only and that changes may be made in detail, especially in matters of shape, size, arrangement of parts or sequence or elements of aspects of the invention within the principles of the invention to the full extent indicated by the broad general meaning of the terms in which the appended claims are expressed.

What is claimed is:

1. A surface preparation apparatus for treatment of a surface to be prepared when interconnected with and drawn in a first direction by a prime mover having an independent power source, the surface preparation apparatus comprising:

a surface treatment unit and a tow bar pivotally interconnected with the surface treatment unit it a first pivot point; the surface treatment unit including a cutter drum having a horizontal rotational axis, a power source to drive the cutter drum and a wheeled support assembly for supporting the surface treatment unit above the surface to be prepared; wherein the tow bar is removably and pivotally attachable to the prime mover when drawn in the first direction, the first pivot point being behind the horizontal rotational axis with respect to movement in the first direction.

2. The surface preparation apparatus of claim 1, wherein the tow bar is slideably interconnected with the surface treatment unit at a location forward of the first pivot point, the surface treatment unit including a pivot mechanism having at least one linear actuator for pivoting the surface treatment unit with respect to the tow bar, the linear actuator pivotally interconnecting the surface treatment unit with the tow bar.

3. The surface preparation apparatus of claim 2, wherein the wheeled support assembly includes at least two wheels and the pivot mechanism includes at least two linear actuators pivotally interconnecting the surface treatment unit to the tow bar.

4. The surface preparation apparatus of claim 2, wherein the tow bar is interconnected to the surface treatment unit at the first pivot point which is located in a horizontal center of the surface treatment unit and the cutter drum is located in a position which is offset to the left or right of the center.

5. The surface preparation apparatus of claim 2, wherein the surface treatment unit can travel in the first direction which is parallel with a second direction followed by the prime mover when the surface preparation apparatus is drawn behind the prime mover in an offset position to the left or right of the prime mover and the prime mover is traveling in a straight line.

6. The surface preparation apparatus of claim 2, wherein the wheeled support assembly includes a lift mechanism for varying the elevation of the surface treatment unit with respect to the surface to be prepared.

7. The surface preparation apparatus of claim 2, wherein the wheeled support assembly includes a tilt mechanism for tilting the surface treatment unit with respect to the surface to be prepared.

8. The surface preparation apparatus of claim 2, wherein the wheeled support assembly includes at least two wheels and the pivot mechanism includes at least two linear actuators pivotally interconnecting the surface treatment unit to the tow bar; wherein the surface treatment unit can travel in the first direction which is parallel with a second direction followed by the prime mover when the surface preparation apparatus is drawn behind the prime mover in an offset position to the left or right of the prime mover and the prime mover is traveling in a straight line; wherein the wheeled support assembly includes a lift mechanism for varying the elevation of the surface treatment unit with respect to the surface to be prepared; and wherein the wheeled support assembly includes a tilt mechanism for tilting the surface treatment unit with respect to the surface to be prepared; the surface preparation apparatus further comprising a control mechanism which allows the pivot, lift and tilt mechanisms to be actuated from the prime mover.

9. The surface preparation apparatus of claim 2, wherein the power source is independent of any source of power provided by the prime mover and provides sufficient power to drive the cutter drum so that a horsepower ratio of the horsepower driving the cutter drum divided by the horizontal width of the surface of the cutter drum is at least about 48 horsepower per foot.

10. The surface preparation apparatus of claim 2, wherein the surface treatment unit includes a housing having a width, the width being less than 7 feet 4 inches so as to fit into a standard shipping container for multiple mode shipping.

11. The surface preparation apparatus of claim 1, wherein the tow bar is slideably interconnected with the surface treatment unit at a location forward of the first pivot point, the surface treatment unit including a pivot mechanism having at least one linear actuator for pivoting the surface treatment unit with respect to the tow bar, the linear actuator pivotally interconnecting the surface treatment unit with the tow bar; wherein the wheeled support assembly includes at least two wheels; wherein the wheeled support assembly includes a lift mechanism for varying the elevation of the surface treatment unit with respect to the surface to be prepared; and wherein the wheeled support assembly includes a tilt mechanism for tilting the surface treatment unit with respect to the surface to be prepared; the surface preparation apparatus further comprising a control mechanism which allows the pivot, lift and tilt mechanisms to be actuated from the prime mover.

12. The surface preparation apparatus of claim 11, wherein the pivot mechanism includes at least two linear actuators pivotally interconnecting the surface treatment unit to the tow bar and each of the lift and tilt mechanisms include at least two linear actuators, the linear actuators being hydraulic cylinders.

13. A surface preparation apparatus for treatment of a surface to be prepared when interconnected with and drawn in a first direction by a prime mover having an independent power source, the surface preparation apparatus comprising:

a surface treatment unit, and a tow bar pivotally interconnected with the surface treatment unit; the surface treatment unit including a housing; a cutter drum rotatably mounted within said housing; a wheel support assembly to support the surface treatment unit above the surface to be prepared; the tow bar being pivotally interconnected with the surface treatment unit at a first pivot point; the cutter drum having a horizontal rotational axis, wherein the tow bar is removably and pivotally attachable to the prime mover when drawn in the first direction; the first pivot point being behind the horizontal rotational axis with respect to movement in the first direction; the housing having a width, the width being less than 7 feet 4 inches so as to fit into a standard shipping container for multiple mode shipping.

14. The surface preparation apparatus of claim 13, the surface treatment unit further including a longitudinal axis, and a transverse axis.

15. The surface preparation apparatus of claim 14, wherein the cutter drum is off-set from the transverse axis.

16. A surface preparation apparatus for treatment of a surface to be prepared when interconnected with and drawn in a first direction by a prime mover having an independent power source, the surface preparation apparatus comprising:

a surface treatment unit, and a tow bar pivotally interconnected with the surface treatment unit; the surface treatment unit including a housing; a cutter drum rotatably mounted within said housing; a wheel support assembly to support the surface treatment unit above the surface to be prepared; the tow bar being pivotally interconnected with the surface treatment unit at a first pivot point; the cutter drum having a horizontal rotational axis, wherein the tow bar is removably and pivotally attachable to the prime mover when drawn in the first direction; the first pivot point being behind the horizontal rotational axis with respect to movement in the first direction; and the surface treatment unit includes a power source, the power source being independent of any power source provided by the prime mover and the power source provides sufficient power to drive the cutter drum so that a horsepower ratio of the horsepower driving the cutter drum divided by the horizontal width of the surface of the cutter drum is at least about 48 horsepower per foot.

17. The surface preparation apparatus of claim 16, the surface treatment unit further including a longitudinal axis, and a transverse axis; wherein the cutter drum is off-set from the transverse axis.

18. A surface preparation apparatus for treatment of a surface to be prepared when interconnected with and drawn in a first direction by a prime mover having an independent power source, the surface preparation apparatus comprising:

a surface treatment unit having a housing, a longitudinal axis, a transverse axis, and a tow bar pivotally interconnected with the surface treatment unit at a first pivot point; the transverse axis being parallel with the first direction, the surface treatment unit further including a cutter drum having a horizontal rotational axis, a power source to drive the cutter drum and a wheeled support assembly for supporting the surface treatment unit above the surface to be prepared; wherein the tow bar is removably and pivotally attachable to the prime mover when drawn in the first direction, the first pivot point being behind the horizontal rotational axis with respect to movement in the first direction; wherein the cutter drum is off-set from said transverse axis.

19. The surface preparation apparatus of claim 18, wherein the rotational axis of the drum cutter is perpendicular to the transverse axis of the surface treatment unit.

20. The surface preparation apparatus of claim 19, wherein the surface treatment unit can travel in the first direction and the first direction is parallel with a second direction followed by the prime mover when the surface preparation apparatus is drawn behind the prime mover in an offset position to the left or right of the prime mover and the prime mover is traveling in a straight line.

21. A surface preparation apparatus for attachment behind a prime mover capable of pulling the surface preparation apparatus in a forward direction along an asphalt road bed surface including compacted particulate materials, the prime mover having an independent power source, the surface preparation apparatus comprising:

a housing; a support mechanism interconnected with the housing for engaging the ground surface and supporting the housing above the asphalt road bed surface; a pivotally attached tow bar for pivotal attachment to the prime mover, the tow bar being pivotally attached to the housing at a first pivot point; a power driven cutter drum for pulverizing compacted particulate materials, wherein the cutter drum rotates about a rotational axis; a pivot mechanism including at least one linear actuator interconnecting the housing with the tow bar at a point or points removed from the first pivot point, wherein the linear actuator can function to cause the housing to pivot with respect to the tow bar and move the housing to one side or the other of a first line consistent with a forward path of the prime mover when the prime mover is moving forward in a straight path; wherein the surface preparation apparatus is arranged and constructed such that the rotational axis of the cutter drum is perpendicular to the first line when the prime mover is moving forward in a straight path and the housing is displaced to one side or the other of the first line.

22. The surface preparation apparatus of claim 21, wherein the support mechanism includes a wheeled support assembly for supporting the surface treatment unit above the asphalt road bed surface, the wheeled support assembly including at least two wheels, and the rotational axis is located in front of the first pivot point.

23. The surface preparation apparatus of claim 22, wherein the tow bar pivots about vertical pivot axes with respect to each of the housing and the prime mover when the tow bar is attached to the prime mover and the prime mover is moving forward in a straight path.

24. The surface preparation apparatus of claim 23, wherein the wheeled support assembly includes a lift mechanism for varying the elevation of the housing with respect to the asphalt road bed surface and a tilt mechanism for tilting the housing with respect to the asphalt road bed surface; the surface preparation apparatus further comprising a control mechanism which allows each of the pivot, lift and tilt mechanisms to be individually actuated from a position within the prime mover.

25. A method of reclaiming compacted asphalt material, the method comprising the steps of:

providing a surface preparation apparatus for attachment behind a prime mover capable of pulling the surface preparation apparatus in a forward direction along an asphalt road bed including compacted particulate materials, the prime mover having an independent power source, the surface preparation apparatus including a housing; a support mechanism interconnected with the housing for engaging the ground surface and supporting the housing above the ground surface; a pivotally attached tow bar for pivotal attachment to the prime mover, the tow bar being pivotally attached to the housing at a first pivot point; a power driven cutter drum for pulverizing compacted particulate materials, wherein the cutter drum rotates about a rotational axis; a pivot mechanism including at least one linear actuator interconnecting the housing with the tow bar at a point or points removed from the first pivot point, the linear actuator functioning to cause the housing to pivot with respect to the tow bar and move the housing to one side or the other of a first line consistent with a forward path of the prime mover when the prime mover is moving forward in a straight path; wherein the surface preparation apparatus is arranged and constructed such that the rotational axis of the cutter drum is perpendicular to the first line when the prime mover is moving forward in a straight path and the housing is displaced to one side or the other of the first line; and drawing the surface preparation apparatus behind the prime mover such that the housing is off-set to one side or the other of the first line and the cutter drum is pulverizing a portion of the asphalt road bed surface.

26. The method of reclaiming compacted asphalt material of claim 25, wherein the surface preparation apparatus has a power source, the power source being independent of any source of power provided by the prime mover, the power source providing sufficient power to drive the cutter drum so that a horsepower ratio of the horsepower driving the cutter drum divided by the horizontal width of the surface of the cutter drum is at least about 48 horsepower per foot; and the step of drawing includes drawing the surface preparation apparatus at a speed of greater than about 0.5 miles per hour.

* * * * *